US009060616B2

(12) United States Patent
Cohen

(10) Patent No.: US 9,060,616 B2
(45) Date of Patent: Jun. 23, 2015

(54) COATED SPRINGS AND MATTRESS MADE THEREOF

(76) Inventor: León Blanga Cohen, Mexico City (MX)

( * ) Notice: Subject to any disclaimer, the term of this patent is extended or adjusted under 35 U.S.C. 154(b) by 46 days.

(21) Appl. No.: 13/609,608

(22) Filed: Sep. 11, 2012

(65) Prior Publication Data

US 2013/0081207 A1 Apr. 4, 2013

(30) Foreign Application Priority Data

Oct. 4, 2011 (MX) ..... MX/a/2011/010457

(51) Int. Cl.

| | |
|---|---|
| ***A47C 23/00*** | (2006.01) |
| ***B68G 9/00*** | (2006.01) |
| ***A47C 27/05*** | (2006.01) |
| *A47C 27/06* | (2006.01) |

(52) U.S. Cl.

CPC ..... *A47C 23/002* (2013.01); *Y10T 29/481* (2015.01); *A47C 27/06* (2013.01); *B68G 9/00* (2013.01); *A47C 27/056* (2013.01); *A47C 27/062* (2013.01); *A47C 27/064* (2013.01)

(58) Field of Classification Search

CPC .... A47C 23/002; A47C 27/06; A47C 27/056; A47C 27/062; A47C 27/064; Y10T 29/481; B68G 9/00

USPC ..... 5/720, 717, 718, 724, 730, 731; 267/81, 267/143

See application file for complete search history.

(56) References Cited

U.S. PATENT DOCUMENTS

| | | | | |
|---|---|---|---|---|
| 4,451,946 | A | 6/1984 | Stumpf | |
| 6,295,673 | B1 | 10/2001 | Mossbeck | |
| 6,591,436 | B2 | 7/2003 | de Santis | |
| 7,636,971 | B2 * | 12/2009 | DeMoss | 5/716 |
| 7,845,035 | B2 * | 12/2010 | Letton et al. | 5/727 |
| 8,011,046 | B2 | 9/2011 | Stjerna | |
| 8,176,608 | B2 | 5/2012 | Mossbeck | |
| 8,266,745 | B2 * | 9/2012 | Mossbeck | 5/720 |
| 8,336,142 | B1 * | 12/2012 | See et al. | 5/634 |

FOREIGN PATENT DOCUMENTS

EP 022835 0 A2 * 8/1987

* cited by examiner

*Primary Examiner* — Peter M Cuomo
*Assistant Examiner* — Brittany Wilson
(74) *Attorney, Agent, or Firm* — White & Case LLP

(57) ABSTRACT

The invention describes a coated spring for mattresses that comprises a helical compression spring and a wrapping in the form of a bag containing the spring, wherein the bag containing the spring is injected with a polymeric reaction mixture, which after reacting or curing produces a polymeric foam, preferably of flexible polyurethane up to a desired volume in order to cause the spring to change its flexion or compression properties, as well as the method for its manufacturing and its use in the manufacturing of mattresses of different kinds.

13 Claims, 12 Drawing Sheets

COATED SPRINGS AND MATTRESS MADE THEREOF

FIELD OF THE INVENTION

This invention relates to coated springs filled with flexible polymer foam as well as mattresses produced using coated springs filled with flexible polymer foam.

BACKGROUND OF THE INVENTION

The technique known as the bag technique is very common in the production of mattresses. The bag technique means that springs are wrapped in bags, that is to say, they are individually surrounded by a wrapping material. Thus, springs become flexible in a relatively independent or individual manner in such a manner that they may be flexed individually without affecting nearby springs. Therefore, the comfort of the user is increased and the user's weight is distributed and spread in a more uniform manner over the surface that receives the load.

However, a disadvantage of this type of mattress is that it frequently is very soft for people of great (or different) weight, which complicates mobility in bed as the user turns at several positions throughout sleeping time as the heaviest part of the body plunges more than the rest. This occurs because the caliber of wire is the same in all the springs and those that receive more weight are more compressed; consequently, as time elapses, they wear out and collapse faster thereby reducing the service life of the mattress. Something similar occurs when a person sits repeatedly on the same edge of the mattress. In addition, there is risk of falling from the bed when the user is positioned on the edge of the same or when they sit on the edge, which may cause physical injury.

Patents GB 225,225, U.S. Pat. No. 2,878,012 and U.S. Pat. No. 2,539,003 describe cushions used in vehicle seats with coil springs in which wrappings or coatings are impermeable to air and check valves or the like are provided in order to limit the flow of air in the coating. Consequently, cushioning is provided, which makes coil springs return to a difficult stretched position that reduces oscillation when the vehicle moves on an uneven road or the like. These cushions, however, are not indicated for use in beds.

In addition, U.S. Pat. No. 5,467,489 suggests a coated mattress in which springs are contained in air impermeable capsules and in which check valves are located in the inferior part and in the exit passages of the upper part. This results in flow of air through the mattress, which causes a cooling or refrigerating effect for the user. However, selective cushioning is not obtained. The mattress is also different from the conventional coated mattresses, which consist of separate units that are connected by flexible bonds.

Patent application PCT/NL2005/000226 describes an encapsulated spring unit, adequate for use in mattresses or pillows or the like. This spring unit consists of a helical spring with two axial ends and one closed coating, the coating consisting of one portion of external wrapping stretched between the two axial ends of the spring throughout the external side of the spring, one first portion of the internal coating is stretched inside the spring from one of the ends of the spring, a second portion of internal coating is stretched inside the spring from the opposite end of the spring ends, in which the two internal portions of the coating are joined to each other.

SUMMARY OF THE INVENTION

The invention describes a coated spring for mattresses that comprises a helical compression spring and a wrapping in the form of a bag containing the spring, wherein the bag containing the spring is injected with a polymeric reaction mixture, which after reacting or curing produces a polymeric foam, preferably of flexible polyurethane up to a desired volume in order to cause the spring to change its flexion or compression properties, as well as the method for its manufacturing and its use in the manufacturing of mattresses of different kinds.

BRIEF DESCRIPTION OF DRAWINGS

This invention is described in accordance with drawings in which.

DETAILED DESCRIPTION OF INVENTION

The invention shall now be described with further detail, considering the attached drawings as reference.

Figure 1A:
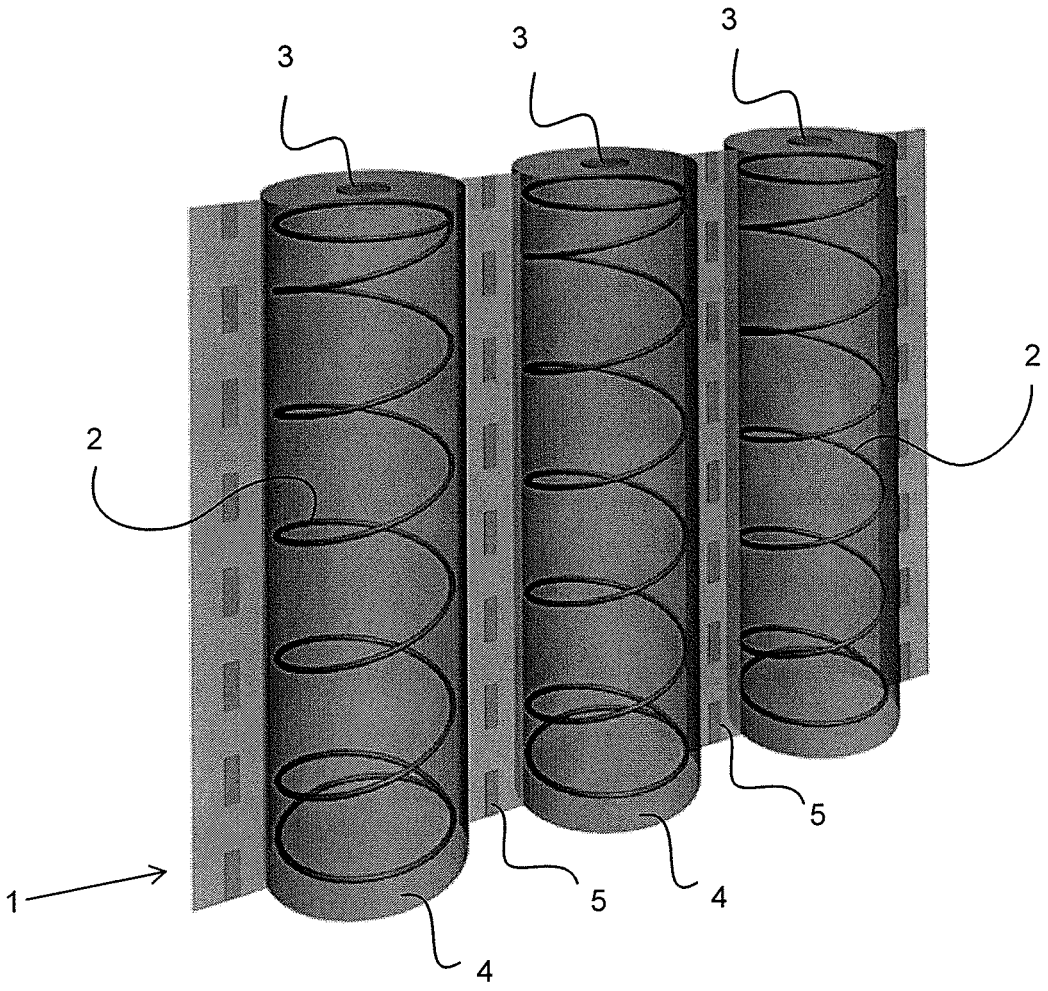
FIG. 1A shows a perspective view of prior art springs for mattresses contained in a bag or coating and joined in series.

FIG. 1A shows a row 1 of helical springs 2 contained in bags 4, which are joined by joint sections 5 in accordance with the prior art. FIG. 1A shows a typical arrangement of the helical springs 2 for the manufacturing of mattresses in which bags or coatings 4 are wrapped separately around each of the springs and joint lines 5 are formed as well, either by ultrasonic welding or gluing. These joint lines 5 are transversal to the longitudinal joint direction of the springs, resulting in the formation of separate bags 4, each containing the respective springs 2 for mattresses. Preferably, joint lines 5 are arranged so that they provide a hermetic demarcation between the bags 4 containing the springs 2.

Figure 1B:
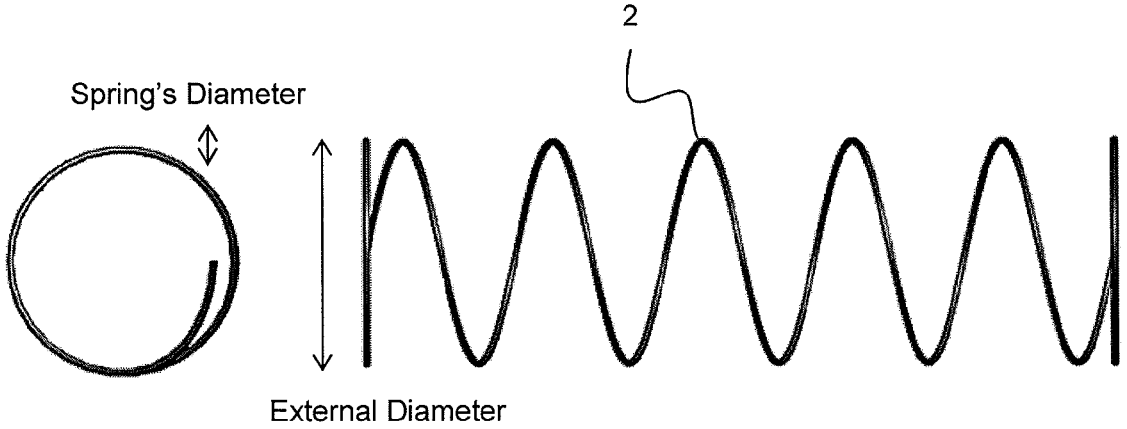
FIG. 1B shows a schematic cross-section view of a helical spring.

FIG. 1B shows a cross-section of the helical spring 2 used in the present invention.

In typical mattress manufacturing, rows 1 of springs 2 for mattresses are distributed side by side until they fill the area of the mattress. Rows are joined to each other through fixation points distributed in an opposite manner to each spring. The number of fixation points may vary depending on the manufacturer. Joining of rows to each other can be achieved through ultrasonic wielding or gluing. However, joining can be made through staples, Velcro straps or any other suitable method.

Mattresses are manufactured in a typical manner by joining rows 1 of springs in coatings that are manufactured automatically, after which, these rows of springs are cut in adequate lengths and then joined.

For the manufacturing of mattresses, helical springs of various diameters and sizes may be used with the present invention, and basically any size or diameter of helical spring may be used. However, helical springs of approximately 5.5 cm of diameter and 16 cm of height are preferred usually. The springs preferably have at least three helical turns and preferably fewer than ten helical turns.

Additionally, the helical springs are made preferably with helical wire with a gauge in the range of 12, 12½, 13, 13½, 14, 14½, 15, 15½, 16, 16½ and 17, with thickness in a range of 0.1 mm to 0.2 mm (0.004 and 0.75 inches) 0.5-3.0 mm, preferably with thickness in the range of 1.25-2.50 mm.

Figure 3A:
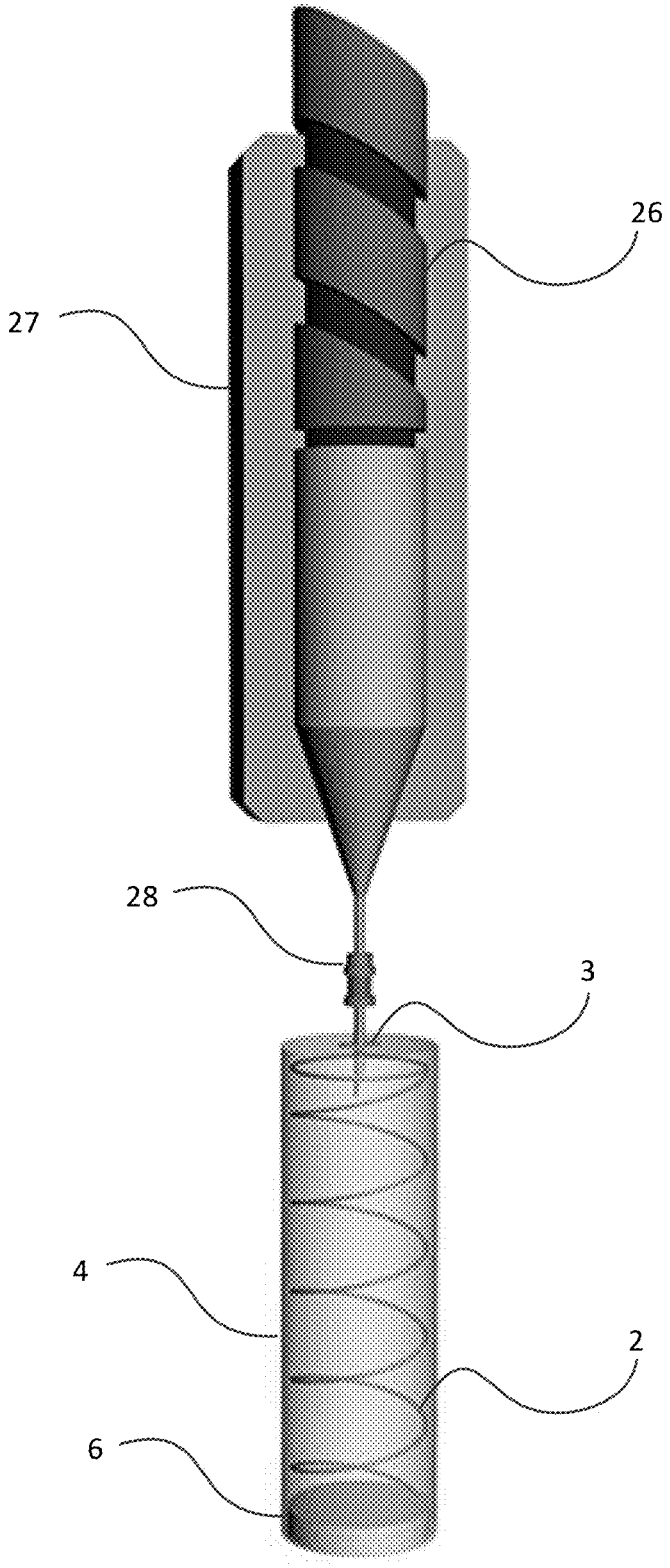
FIG. 3A is a schematic view of the mud gun after a small amount of polymeric reaction mixture has been injected into the bag containing the helical spring for the mattress, according to one embodiment of the invention.
Figure 3B:
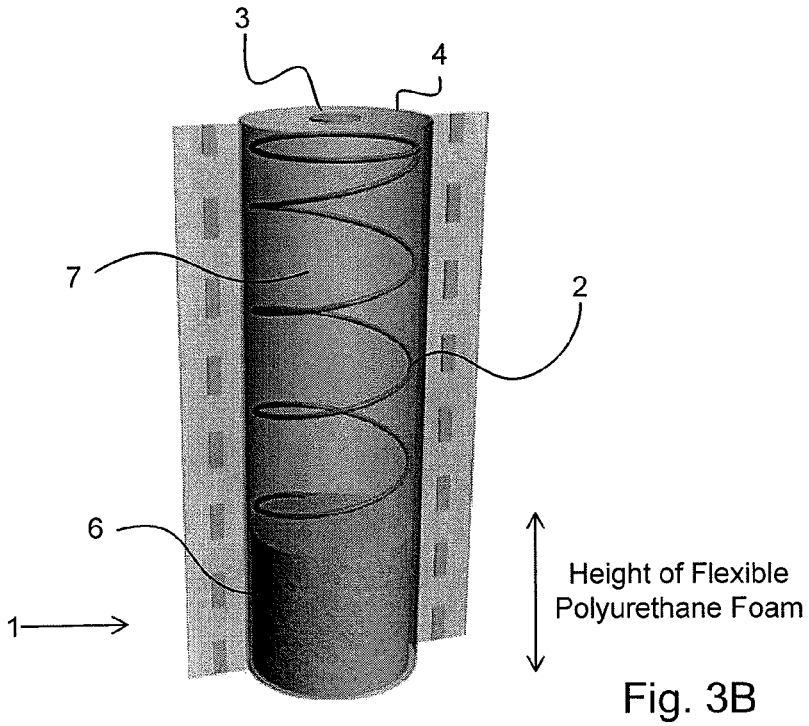
FIG. 3B shows in perspective the moment in which the polymeric reaction mixture has finished "cremating," forming a single flexible polyurethane foam column inside the bag containing the helical spring, according to one embodiment of the invention.
Figure 3C:
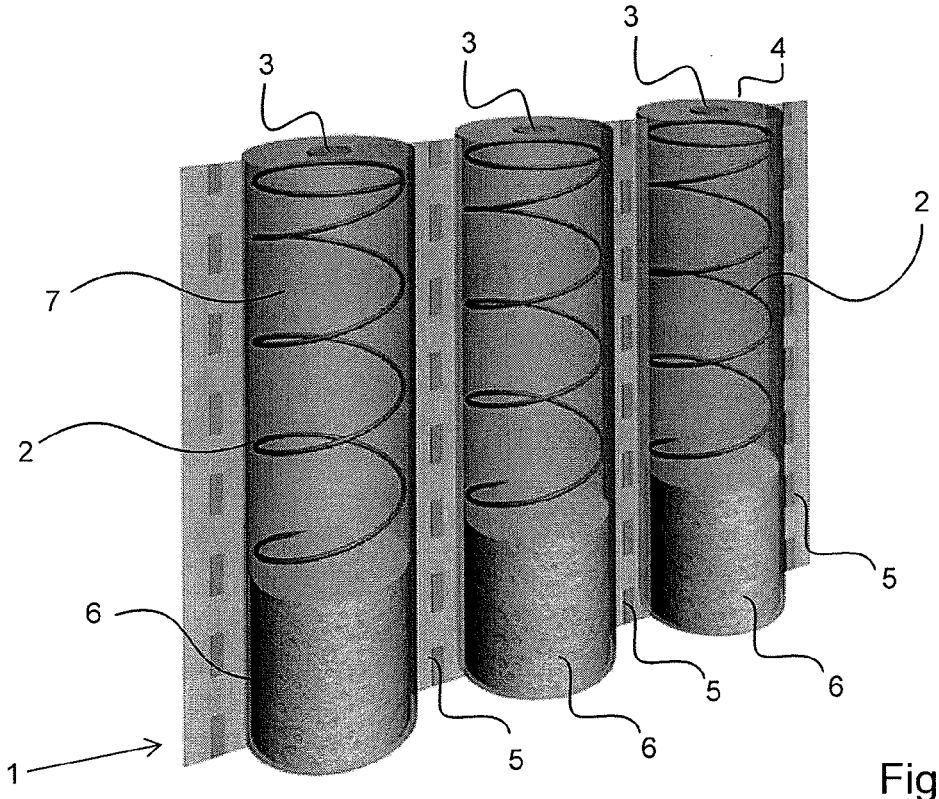
FIG. 3C shows in perspective a row of helical springs for mattresses, contained in a bag or coating and joined in series, in which all bags have a portion filled with flexible polyurethane foam, according to one embodiment of the invention.

FIGS. 3A-3C show a coated spring containing a flexible foam, according to one embodiment of the invention. A helical spring 2 is wrapped in a bag 4 that is partially filled with a flexible polyurethane foam 6.

Wrapping material for bags 4 might be woven or non-woven, hermetic to liquids and hermetic to air as well. This may be achieved using any material that is substantially hermetic to liquids or air. The materials for the bags 4 are preferably hermetic to polyurethane and resistant to the temperature at which a polymeric reaction mixture is injected into the bag 4 until the polyurethane expands and solidifies into flexible polyurethane foam.

The coating or bag material, in conjunction with perforations, if any, preferably provides air permeability that is sufficient to obtain the desired properties of the mattress. Average air permeability of the coating material may be measured, for instance, by a standard method such as SS-EN ISO 9237: 1995 with a differential pressure of 100 Pa through the bag material. Air permeability in this case is preferably in the range of 0.15-1.6 $l/m^2/s$, and more preferably in the range of 0.3-1.4 $l/m^2/s$.

Partially air hermetic bags or receptacles result in air resistance by being pushed when mattress springs carry a load. Under a uniform load for a transition period, the spring is under compression which increases gradually as the spring transitions to its depressed or compressed state.

Figure 6A:
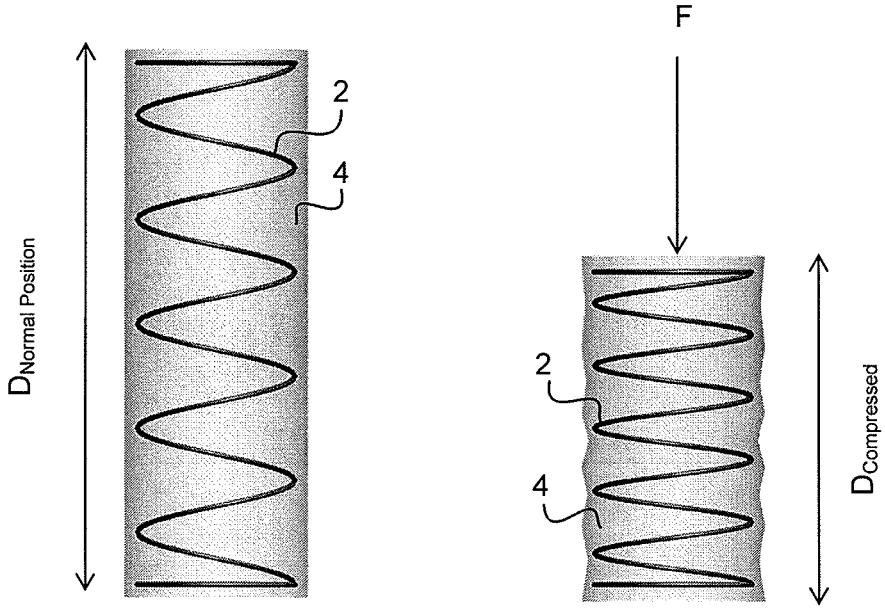
FIG. 6A shows a schematic view of the helical spring inside the bag without polyurethane foam, shown with and without compression.
Figure 6B:
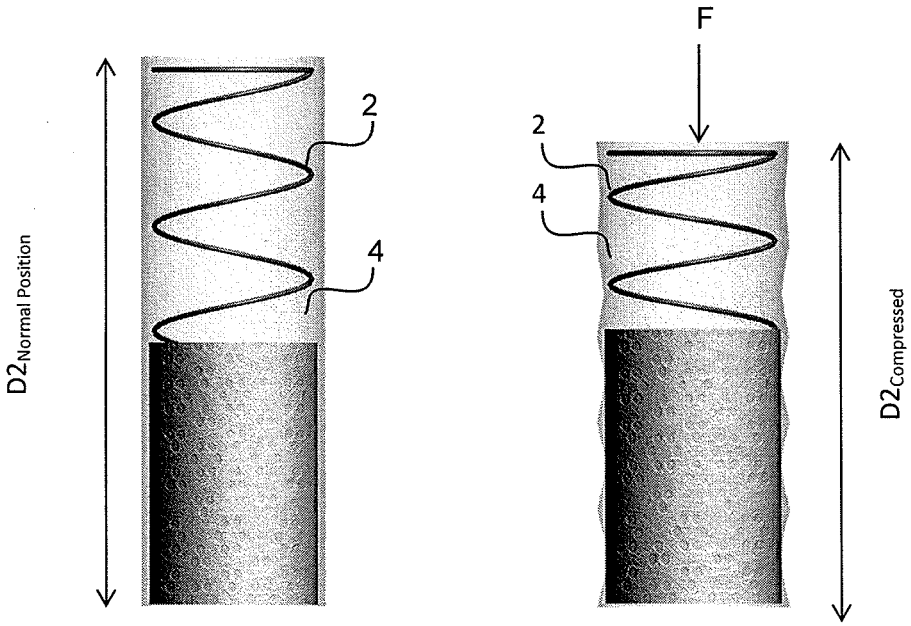
FIG. 6B shows a schematic view of the helical spring inside the bag in which flexible polyurethane foam has been added, shown with and without compression.

The compression of mattress springs as described above is caused by a constant load force, which is schematically illustrated in FIGS. 6A and 6B. When a load force is exerted, the spring compresses initially fast (phase A), during which air expands the side walls of the bag and the spring substantially absorbs the load force. Compression appears during this phase and may be controlled, for instance, by adapting the size of the bags. After this initial compression, the air inside the bags expands the bags, avoiding a greater compression of the spring, and relatively slow compression appears while air is pressed outwards through the slightly air permeable wrapping material. During this phase B, a slow reduction of the spring's height occurs, while the air cushion formed inside the bag absorbs at least some of the load force.

Eventually, so much air has been pressed outwards that the spring substantially absorbs the total load force. In this case, air does not flow outside the bag, nor does the spring have the same compression. This state of balance is designated as phase C.

Under a load, the transition time of the spring until it reaches the state of balance (phase C) depends on several factors, such as air permeability of the wrapping material or bag, the size and force of compression, size of the spring, etcetera. However, these factors are selected adequately in such a manner that under normal conditions, with the spring unit under a load force in the range of 20 N, transition time shall be between 0.5-20 seconds, preferably in the range of 1-15 seconds and more preferably in the range of 1-12 seconds. This transition time consists almost exclusively of phase B as discussed above, as phase A occurs so fast that it is substantially inconsiderable in this context.

It has been discovered, however, that the deflection or compression of the helical spring that is normally used for the manufacturing of mattresses may be modified to be more resistant if a certain amount of chemical products or polymeric mixture is added to the bag containing the helical spring. For instance, in order to foam flexible polyurethane foam or any other foam product through an upper hole 3 of the bag 4, which shall fill the bag 4 containing the spring to a certain level depending on the amount of foam chemical product that is applied, for example, with one third of the total height of the bag 4, the coated spring will have more resistance to depression or compression force exerted on it, after the flexible polyurethane foam has been foamed, expanded and hardened inside the bag 4.

The preferable polymeric reaction mixture to be used and applied in the bag containing the helical spring contains toluene diisocyanate (TDI) and polyalcohols which are the basic ingredients for the production of flexible polyurethane foam, that produce the following reaction:

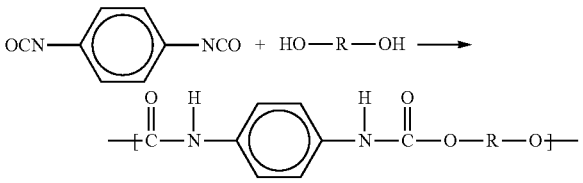

in which a blowing agent is used, such as methyl chloride and water and other additives.

Throughout the production of the polymeric mixture, base materials such as TDI are mixed with polyalcohol, adding blowing agents and additives, pumped from their own storage tank to a common mixing tank. An adequate dispersion may be achieved by shaking with a high speed propeller installed in the mixer. Gas may be introduced or produced in situ in order to form bubbles, as they form a structure in the form of reduced density expanded cells in the cured polyurethane foam. The process of introducing bubbles is known as mechanical blowing or foaming in the formulation. The process of forming bubbles in situ is known as chemical blowing. The greater the amount of gas introduced in the polymeric reaction mixture the lower the density of the resulting foam.

In the preferred embodiment, flexible polyurethane foam is formed from a compound that has been previously foamed in a mechanical manner or chemically blown. Polyurethane foams of this nature might be prepared from formulations that consist of a polyisocyanate component in combination with high levels of a catalyst, a surfactant, and water. The high level of water may cause a chemical blowing of the flexible polyurethane foam compound, when water reacts with the polyisocyanate component of the polyurethane formulation. The combination of mechanical foaming and chemical blowing of the reaction of polyisocyanate and water results in polyurethane foam with densities below those used conventionally. The fact that polyurethane foams produced in this manner may have sufficiently low densities shall be considered, while they have sufficient resiliency and dimensional stability which is desirable for application inside the bags containing helical springs.

Formulations or reaction mixtures used to prepare a flexible polyurethane foam for use in the coated springs of the present invention may have from approximately 0.5 parts up to approximately 3 parts of water for every hundred parts of polyol, preferably from approximately 0.75 up to approximately 2.75 parts for every hundred parts of polyol, and more preferably from approximately 1.5 up to approximately 2.5 parts of water for every hundred parts of polyol. Formulations or reaction mixtures of the present invention may include from approximately 0.01 parts up to approximately 3.5 parts of urethane catalyst for every hundred parts of polyol and from 1 up to 2 parts of surfactant for every hundred parts of polyol.

The flexible polyurethane foam to be introduced to the bag containing a helical spring shall have a desired density, which may vary in the range of 10 to 50 kg/m$^3$, preferably from 15 to 45 kg/m$^3$, more preferably of 17 to 30 kg/m$^3$ in order to generate the reinforcing effect of the helical spring. Therefore, the combination of a helical spring with flexible polyurethane foam inside the bag that contains the same will be more resistant to deflection when a force is loaded on it, in comparison with a spring that does not have flexible polyurethane foam.

Figure 2:
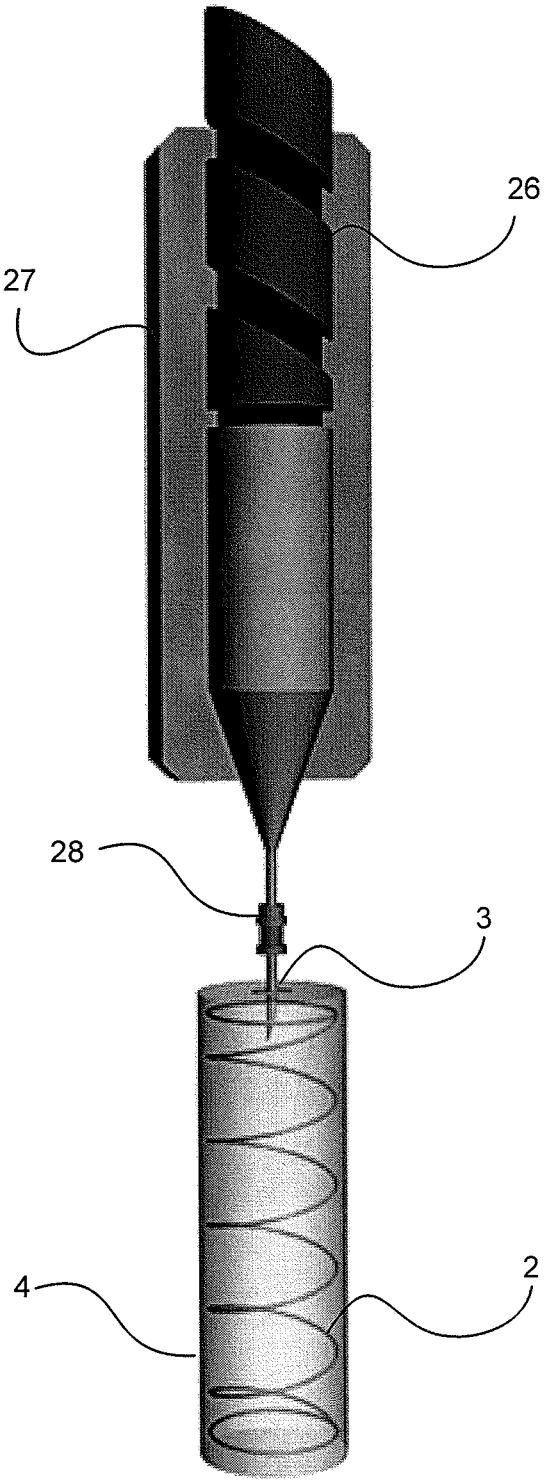
FIG. 2 is a schematic view of a mud gun that injects a polymeric reaction mixture into the bag or coating containing the helical spring, according to one embodiment of the invention.

As schematically shown in FIG. 2, the reaction mixture is added through a tract 26 of an injector. The tract 26 crosses through the body 27 of the injector and sends the polymeric mixture of the reaction towards a mud gun 28 of the injector through which the mixture is injected through a hole 3 located in the upper part of the bag 4 containing the helical spring 2.

FIG. 3A shows in a schematic manner the moment in which the polymeric reaction mixture 6 has been injected inside the bag 4 which contains the helical spring 2 and remains in the bottom of the bag 4. The amount of injected polymeric reaction mixture is previously calculated in such a manner that upon reaction and foaming, or "cremation," of the polymeric reaction mixture, the foam formed from flexible polyurethane reaches a certain previously calculated and determined height. It is worth noting that laboratory tests have been made in order to determine the exact amount of polymeric reaction mixture (dose) that produces specific heights of flexible polyurethane foam inside the bag 4 containing the helical spring 2.

FIG. 3B shows the moment in which flexible polyurethane foam 6 has foamed or "cremated" and reached its maximum height at which it shall cure. FIG. 3C shows a row or series 1 of bags 4 containing helical springs 2, which have been injected with the same amount of the polymeric reaction mixture and at which it is observed that flexible polyurethane foam 6 has reached the same height in all of them after the foaming or "cremation," while portion 7 of each bag 4 remains without flexible polyurethane foam. Bags 4 are shown as joined through ultrasonic welding or through gluing at joint lines 5. This joining of the bags 2 may be carried out as well through staples, Velcro straps, or any other suitable manner.

Figure 4A:
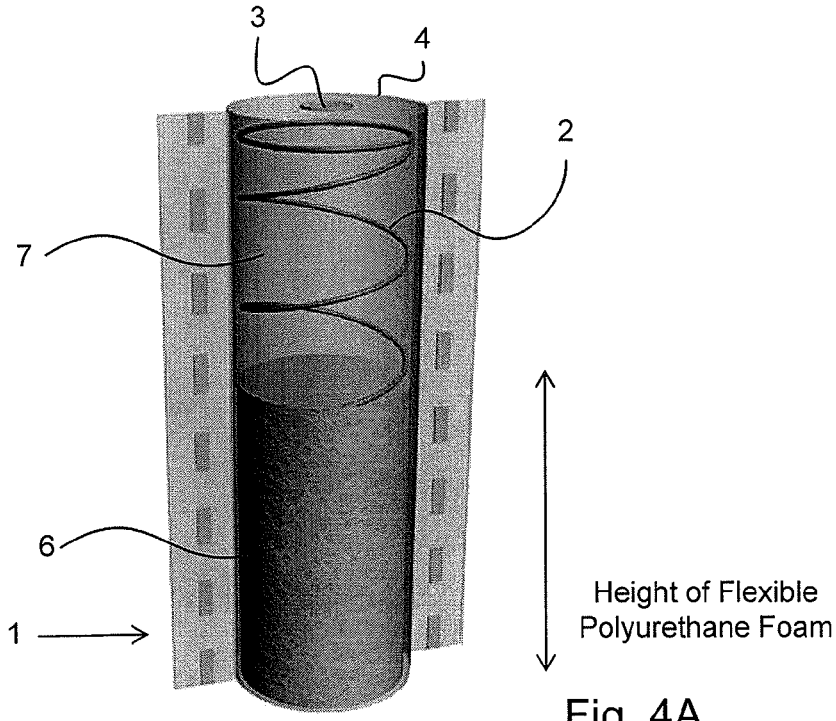
FIGS. 4A and 4B show perspective views of the coated springs for mattresses, contained in a bag or coating and joined in series, having a greater portion of the bag filled with flexible polyurethane foam in comparison with the coated springs shown in FIGS. 3A-3C, according to another embodiment of the invention.
Figure 4B:
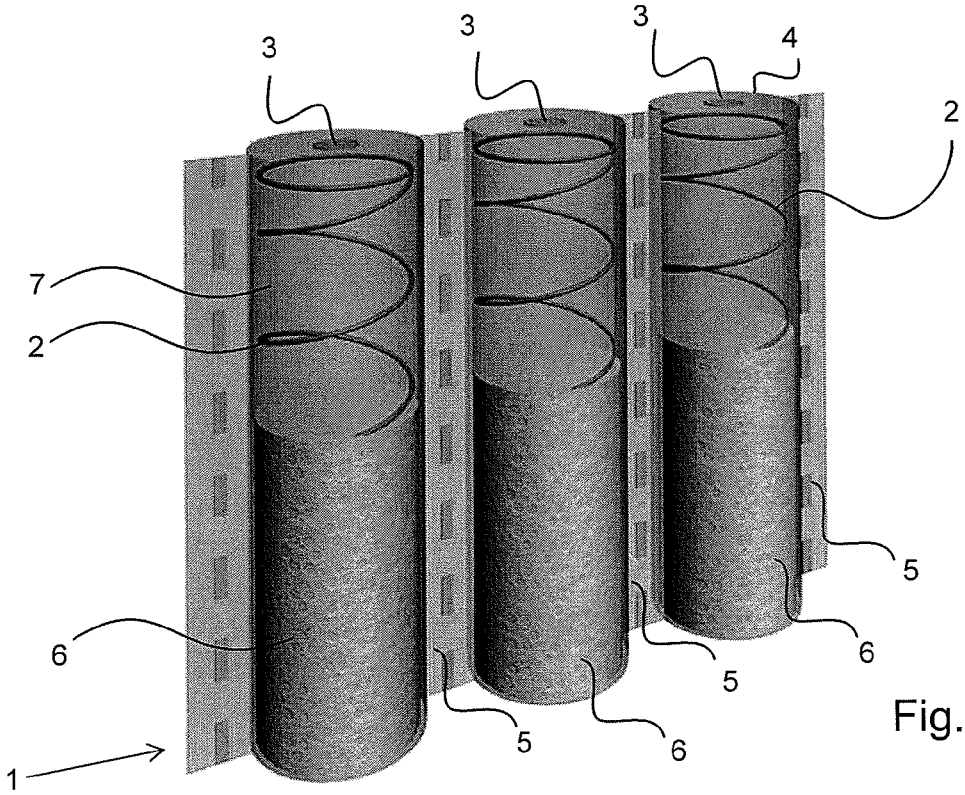

FIG. 4A shows another embodiment in which flexible polyurethane foam 6 has foamed or "cremated" and has reached its maximum height approximately up to half the height of the helical spring 2. FIG. 4B shows a row or series of bags 4 containing the helical springs 2, in which each bag 4 has been injected with the same amount of polymeric reaction mixture and in which it is observed that the flexible polyurethane foam 6 has reached the same height in all of them after the foaming or "cremation," while the portion 7 of bag 4 remains without flexible polyurethane foam. Bags are joined through ultrasonic welding or through gluing at joint lines 5. This joining of the bags 2 may be carried out as well through staples, Velcro straps, or any other suitable manner.

Figure 5A:
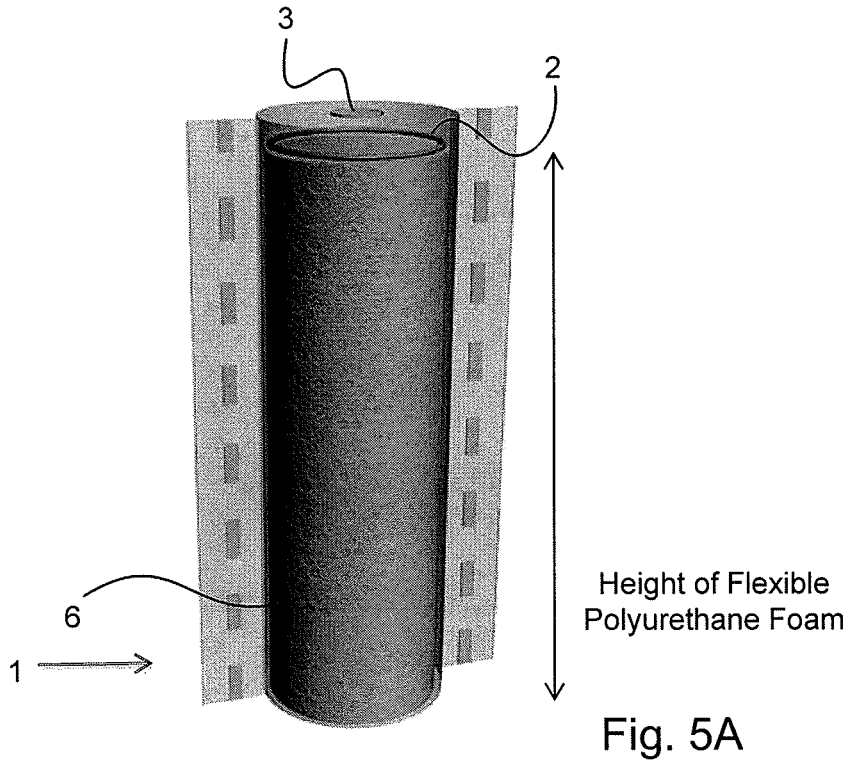
FIGS. 5A and 5B show perspective views of the coated springs for mattresses, contained in a bag or coating joined in series, having the bag fully filled with flexible polyurethane foam, according to another embodiment of the invention.
Figure 5B:
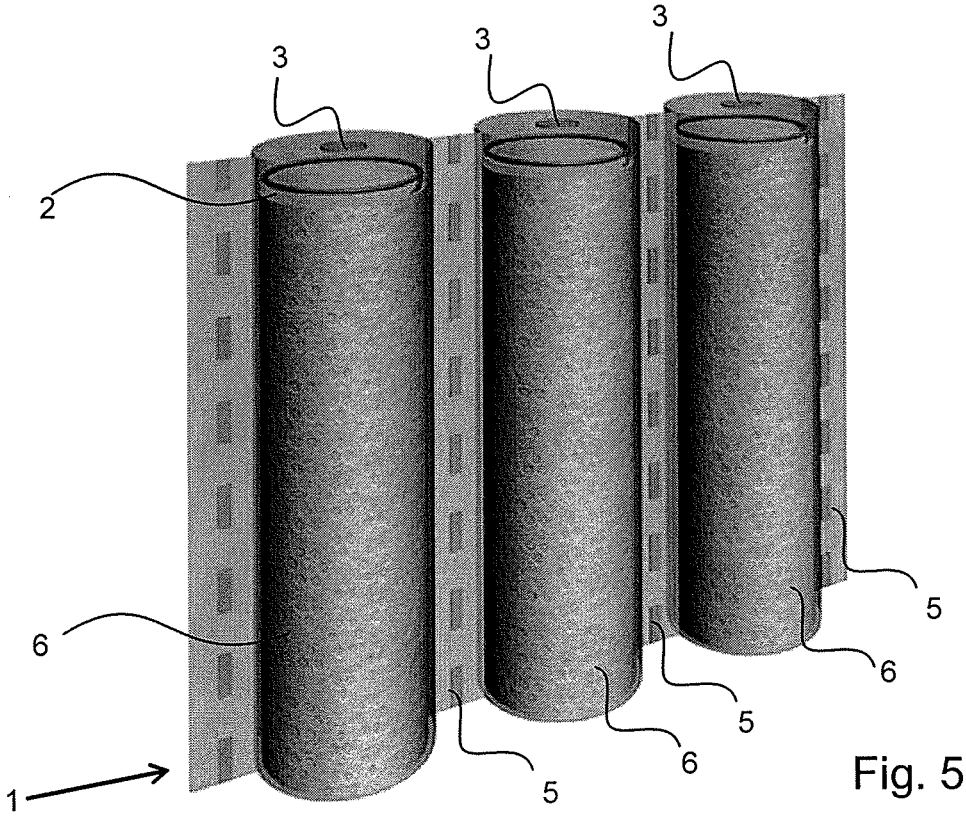

In another embodiment, FIGS. 5A and 5B show flexible polyurethane foam 6 fully filling the bag 4 containing the helical spring 2; therefore, portion 7 free of polyurethane foam disappears and is not shown. It has been observed that when this occurs, the helical spring's resistance to deflection increases, that is to say, the greater the amount of flexible polyurethane foam 6 in the bag 4 containing the helical spring 2, the stronger resistance of the coated spring to deflection becomes.

The proportion or rate (k) of the spring may be measured by calculating the existing difference between the force of a maximum deflection of 80% and a minimal deflection of 20%, and dividing the same by the difference in the deflection. The proportion of the spring tends to be constant over 60 percent of central deflection. Due to effects external to the spring, the first 20% of the deflection range has a considerably inferior spring proportion. The last 20% of deflection show a considerably high spring proportion. When a particular spring is designed, the design for loads and critical proportions shall be within the range of 60% of central deflection.

The following design equation of the helical compression spring shall determine the force of the given variables:

$$\text{Force } (F)=k(D_{normal\ position}-D_{compressed}) \quad \text{(Equation 1)}$$

where:

F=Force exerted on the spring $D_{normal\ position}$=free length over the spring without applied force $D_{compressed}$=length of the spring with applied force k=spring constant determined either experimentally or through calculation.

FIG. 6A shows an example of the helical spring 2 located inside the bag 4 both in the normal position and in the compressed position. FIG. 6A shows a helical spring 2 that does not contain any flexible polyurethane foam. This helical spring 2 is flexed under a force F up to a distance $D_{compressed}$. FIG. 6B shows a helical spring 2 which has added flexible polyurethane foam which is flexed at a distance $D_{2compressed}$ under the same force F as in FIG. 6A but in which there is a higher resistance to compression or deformation caused by the flexible polyurethane foam 6, therefore, $D_{compressed}$ is greater than $D_{2compressed}$.

An example of the calculation of compression in a helical spring 2 is the following:

| | | |
|---|---|---|
| Force F applied to the spring ($lb_f$) | 7.50 | Applied Force |
| Spring constant k spring ($lb_f$/inch) | 15.0 | Spring constant |
| Length of the spring without compression (inches) $D_{normal\ position}$ | 0.75 | Spring length |
| Length of the spring compressed (inches) $D_{compressed}$ | 0.25 | Compressed spring length |

The equation to determine the spring rate (k) of a helical spring has been determined as:

$$k=Gd^4/[8nD^3] \quad \text{(Equation 2)}$$

where:

k=spring constant (load pounds per deflection inch)

G=rigidity module of spring material (pounds per square inch)

d=wire diameter (inches)

n=number of active turns, that is the number of spirals subject to flexion (always less than the total number of turns)

D=mean diameter of the turn=external diameter−wire diameter.

FIG. 1B shows in a schematic manner the form to determine the mean diameter of a spring turn.

An example of the calculation of the spring constant is shown below:

| Calculation of the spring constant (k) | |
|---|---|
| Design Variables | |
| Rigidity Module (psi) (G) | 30,000,000 |
| Wire diameter in inches(d) | 0.080 |
| Number of active turns (n) | 30.0 |
| Mean diameter of spring's turns (d) | 2.00 |
| Results | |
| Spring constant (k) | 0.6400 |

A table of the materials and properties used for a common spring is shown below:

Materials and Properties for common springs

| Material | Resistance to traction (psi × $10^3$) | Elasticity Module (psi × $10^6$) | Torsion Module (psi × $10^6$) | Maximum Design Temperature (° F.) |
|---|---|---|---|---|
| Wire | 229-300 | 30 | 11.5 | 250 |
| Chrome-Vanadium | 190-300 | 30 | 11.5 | 425 |
| Stainless Steel 302 | 125-320 | 28 | 10 | 550 |
| Stainless Steel 17-7 (313) | 235-335 | 29.5 | 11 | 600 |

All the previous calculations are applicable to a common or regular spring for the manufacturing of mattresses. However, the addition of a polymeric reaction mixture that produces flexible polyurethane foam 6 inside the bag 4 containing the helical spring 2, for instance, up to one third of the helical spring's length as shown in FIGS. 3B and 3C, the constant of springs containing flexible polyurethane foam changes considerably as the portion occupied by the flexible polyurethane foam does not act in the same manner as the portion without flexible polyurethane foam. That is to say, the part or length of the helical spring 2 occupied by the flexible polyurethane foam 6 is not compressed in the same proportion that the part 7 or length of the helical spring 2 free of flexible polyurethane foam. Effectively, the number (n) of active turns subject to deflection decreases.

For instance, in the FIGS. 3A-3C embodiment each coated spring is filled with flexible polyurethane foam up to a third part of the total length of the helical spring 2 that is 18 centimeters in length and has five turns in total. By adding flexible polyurethane inside the bag 4 containing the helical spring 2, the flexible polyurethane foam 6 will reach an approximate height of 6 centimeters, thereby "reinforcing" or "stiffing" two turns of the helical spring 2. Therefore, the number (n) of active turns will be only 3, and considering that (n) is inversely proportional to constant k of the helical spring in accordance with Equation (2), the value of k will increase as the value of n decreases.

Now then, in accordance with Equation (1), k is directly proportional to the force (F) exerted on the helical spring. Consequently, by increasing k, F shall be increased as well, that is to say, a greater force shall be required to exert compression or deflection on the helical spring containing flexible polyurethane foam inside compared to the force required to exert the same pressure over a helical spring that does not contain flexible polyurethane foam inside.

In light of the above, helical springs containing flexible polyurethane foam inside have a greater rigidity than those not containing flexible polyurethane foam. This rigidity increases as the amount of flexible polyurethane foam is increased inside the bag or cavity containing the helical spring. That is to say, a helical spring contained in a bag that has been filled up to approximately half of its total length with flexible polyurethane foam has a greater rigidity that one containing only a third part of its total length of flexible polyurethane foam.

In other embodiments, bags 4 containing helical springs 2 are filled up to 50% of the helical spring's height with flexible polyurethane foam 6 as shown in FIGS. 4A-4B and an embodiment in which the entirety of the bag 4 containing the helical spring 2 has been filled with flexible polyurethane foam 6 as shown in FIGS. 5A-5B. However, within the scope of the present invention, there exists the possibility of manufacturing coated springs with specific rigidity according to the client's request, through the variation of the amount of flexible polyurethane foam that is added to the bag containing the helical spring and the foam's density.

On the other hand, as previously explained, it is also known that flexible polyurethane foam might be manufactured with different densities, as it is the product of the reaction of TDI, polyol, and water. The density of the resulting polymeric foam may vary depending on the proportion of water that is added to the reaction mixture, that is to say, the smaller the proportion of water in the reaction mixture the denser the resulting polyurethane foam will become, while a greater amount of water in the reaction mixture will result in polyurethane foam with less density and rigidity. These characteristics of the flexible polyurethane foam and its flexibility in manufacturing make possible the great range of existing variations in the density of flexible polyurethane foam that might be used to fill bags, and consequently, a wider range in the rigidity values of the helical springs that are filled with the flexible polyurethane foam. By increasing or decreasing the amount of polyurethane foam in any of its chosen densities inside the bag containing the helical spring, it is possible to vary the softness or firmness for better comfort of the user.

Figure 7A:
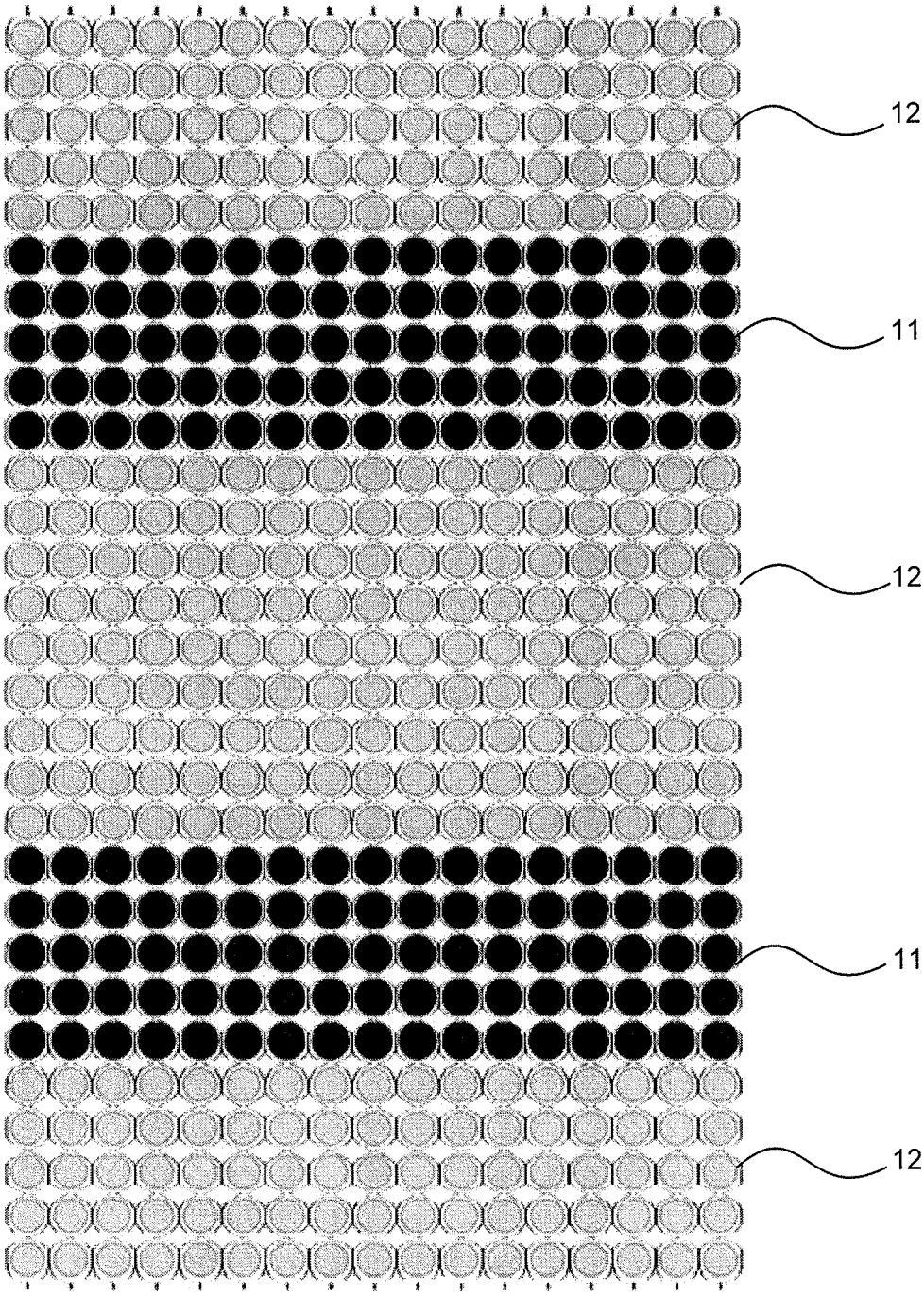
FIG. 7A shows a plan view of a spring unit for a mattress or mattress frame, the spring unit including coated springs filled with flexible polyurethane foam, distributed in certain areas which require additional support and durability.
Figure 7B:
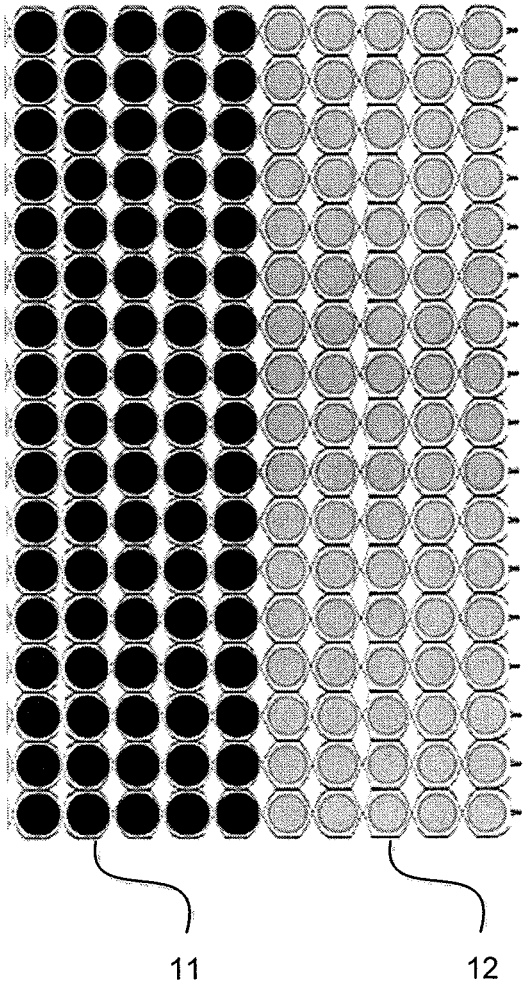
FIG. 7B shows another embodiment of a spring unit for a mattress or mattress frame, the spring unit formed by coated springs filled with flexible polyurethane foam as well as springs without polyurethane foam filling.

From the above, it is possible to manufacture mattresses with specific rigidity in certain areas of the mattress, preferably in areas such as those in which the back rests at the level of the shoulders and the pelvis of the user. FIG. 7A shows an embodiment of such a mattress, where helical springs filled with flexible polyurethane foam are placed in the areas indicated with the reference 11, which correspond to the areas in which the shoulders and the pelvis would typically rest, and reference 12 indicates the sections of the mattress formed by typical mattress springs, that is to say, those that do not contain flexible polyurethane foam. FIG. 7B shows another embodiment of the mattress in which approximately half of the mattress is formed by helical springs filled with flexible polyurethane foam in area 11 to support the weight of a heavier person, while area 12 is formed with springs that do not contain flexible polyurethane foam to support the weight of a lighter person. In this manner, the deflection of the springs in both sections would become approximately uniform thereby generating more comfort for the users of the double size mattress and avoiding non-uniform wearing of the springs due to the differential load generated by the weight difference of the users of the mattress. Sections of springs containing flexible polyurethane foam in their bags may be placed in the areas of the mattress that are most suitable for a particular user.

Figure 8:
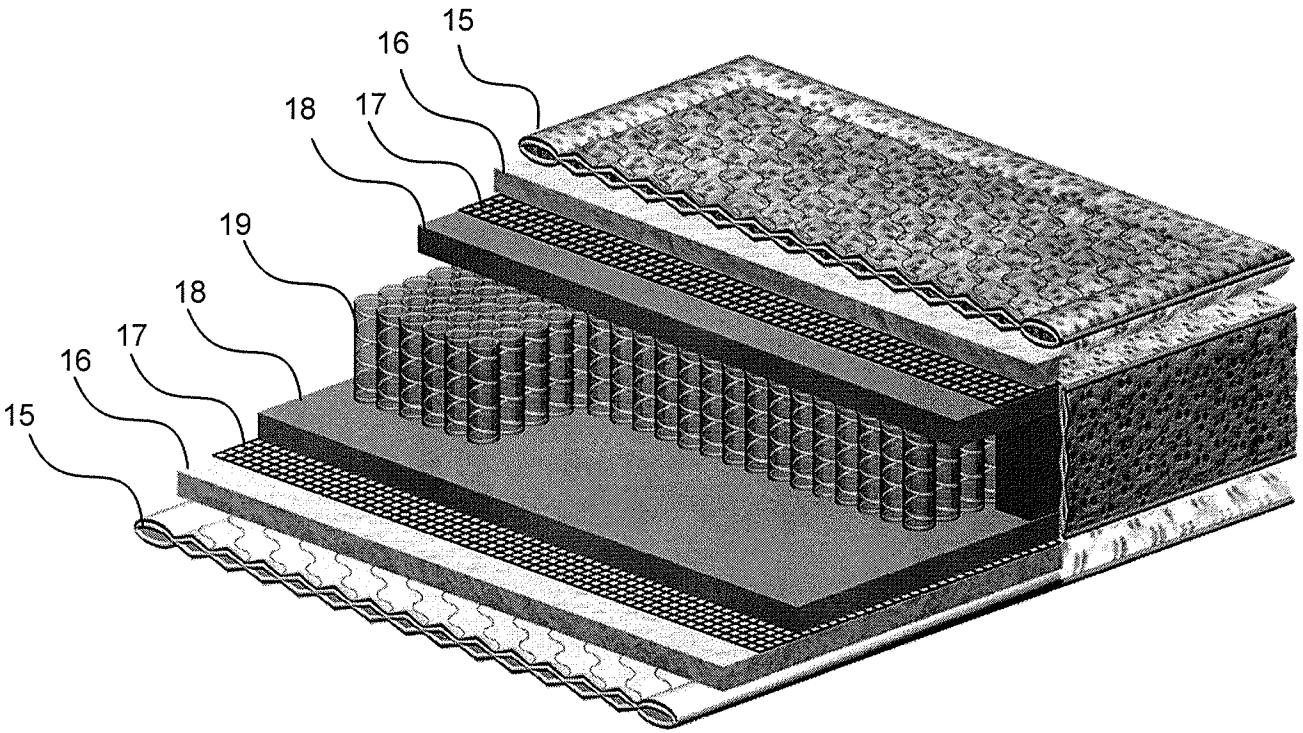
FIG. 8 shows a cross-section view of a mattress that includes a spring unit according to one embodiment of the invention.

FIG. 8 shows in detail all the layers of material that form a mattress, in which it may be observed that unit 19 formed by springs is the intermediate part, coated by upper and lower layers of several materials; namely, the external layer 15 formed by polyester fiberfill cushioning, layer 16 formed by cushioning material, layer 17 formed of woven or nonwoven fabric, and layer 18 formed of cushioning made of cotton, wool, or synthetic material. Spring unit 19 may be formed by areas 11 formed by helical springs in bags filled with flexible polyurethane foam as shown in FIGS. 7A and 7B. The aforementioned layers 15, 16, 17, & 18 are repeated both over spring unit 19 as well as under spring unit 19.

Figure 9A:
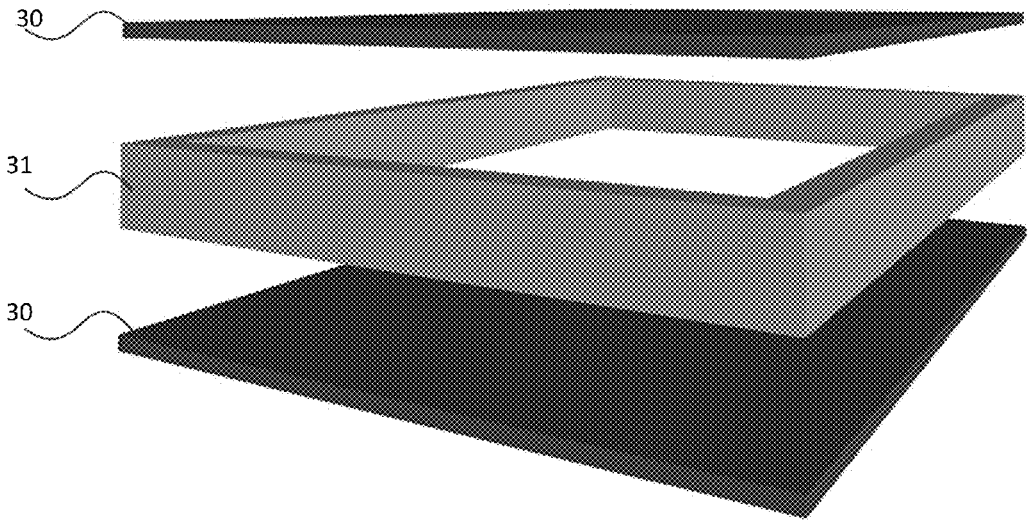
FIG. 9A shows a schematic view of a mattress frame, to contain a spring unit according to one embodiment of the invention.
Figure 9B:
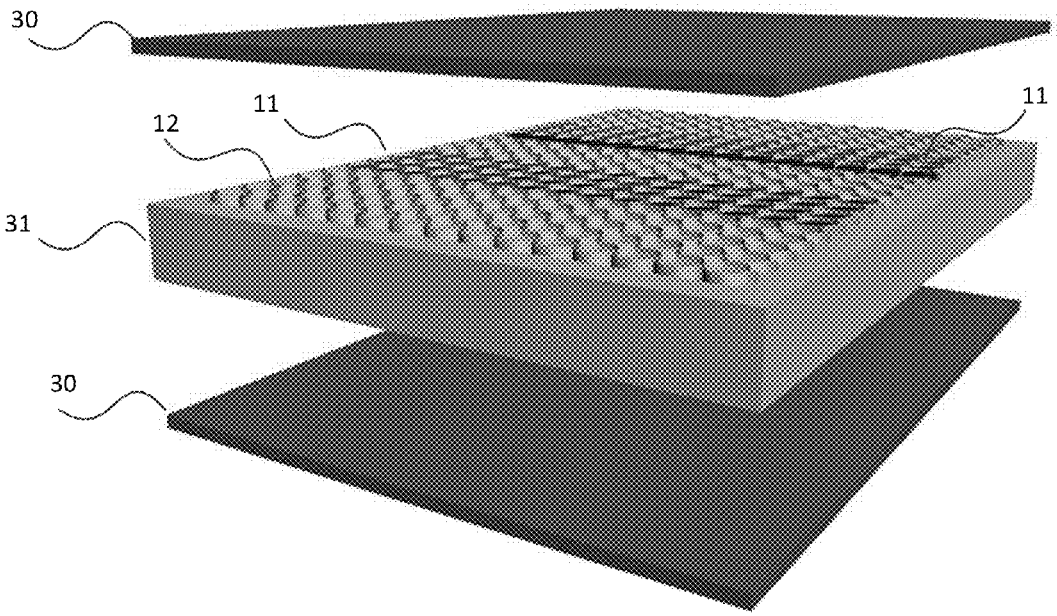
FIG. 9B shows a schematic view of a mattress frame that includes a spring unit according to one embodiment of the invention.

Alternatively, a mattress may be manufactured as shown in FIG. 9A, in which a box or frame 31 is formed with polyurethane foam having a layer 30 of polyurethane that serves as an upper lid and a similar polyurethane layer 30 to be used as a base lid of the lower area of the mattress. FIG. 9B shows the spring unit inserted inside the frame 31, the spring unit being formed by the areas 11 that indicate the position of helical springs in bags that contain flexible polyurethane foam and areas 12 formed by the springs that do not contain flexible polyurethane foam.

The invention has been described above with reference to specific embodiments. It will, however, be evident that various modifications and changes may be made thereto without departing from the broader spirit and scope of the invention as set forth in the appended claims. The foregoing description and drawing are, accordingly, to be regarded in an illustrative rather than a restrictive sense.

What is claimed is:

1. A coated spring for mattresses comprising:

a helical spring; and a bag containing the helical spring, the bag containing the helical spring further containing a flexible polymer that forms a combination with a portion of the helical spring such that the flexible polymer causes a change in the compression properties of the portion of the helical spring combined with the flexible polymer, the change in the compression properties depending on the height of the flexible polymer within the bag, the flexible polymer formed by a polymeric reaction mixture having a predetermined volume introduced into the bag.

2. The coated spring for mattresses of claim 1, wherein the flexible polymer is flexible polyurethane.

3. The coated spring for mattresses of claim 1, wherein the flexible polymer is any polymer material that forms a foam.

4. The coated spring for mattresses of claim 1, wherein the flexible polymer forms a foam having a density range from about 10 to about 50 kg/m$^3$, preferably from 15 to 45 kg/m3, and more preferably from 17 to 30 kg/m$^3$.

5. The coated spring for mattresses of claim 1, wherein the coated spring is connected in a row with at least one other coated spring.

6. The coated spring for mattresses of claim 1, wherein the bag is formed of a wrapping material that is hermetic to liquid but especially hermetic to a polymeric reaction mixture that forms the flexible polymer.

7. The coated spring for mattresses of claim 6, wherein the wrapping material is a textile material, nonwoven fabric, or polymeric material.

8. The coated spring for mattresses of claim 1, wherein the rigidity of the coated spring depends on the amount of flexible polymer in the bag and the density of the flexible polymer.

9. A mattress comprising:

a plurality of coated springs, wherein each coated spring includes a helical spring; and a bag containing the helical spring, the bag containing the helical spring further containing a flexible polymer that forms a combination with a portion of the helical spring such that the flexible polymer causes a change in the compression properties of the portion of the helical spring combined with the flexible polymer, the change in the compression properties depending on the height of the flexible polymer within the bag, the flexible polymer formed by a polymeric reaction mixture having a predetermined volume introduced into the bag, the plurality of coated springs being arranged in at least one area of the mattress.

10. The mattress of claim 9, wherein the amount of the flexible polymer in each of the plurality of coated springs is predetermined to comply with predetermined rigidity criteria.

11. The mattress of claim 9, wherein the density of the flexible polymer in each of the plurality of coated springs is predetermined to comply with predetermined rigidity criteria.

12. The mattress of claim 9, wherein a portion of the plurality of coated springs contains flexible polymer of a different density than another portion of the plurality of coated springs.

13. The mattress of claim 9, further comprising at least one helical spring in a bag not containing a flexible polymer.

* * * * *